United States Patent [19]

Brewer

[11] Patent Number: 4,944,457

[45] Date of Patent: Jul. 31, 1990

[54] OSCILLATING DEVICE FOR FLUID NOZZLES

[76] Inventor: Mark Brewer, 25 W. 343 Highview, Naperville, Ill. 60540

[21] Appl. No.: 345,460

[22] Filed: May 1, 1989

[51] Int. Cl.[5] ..... B05B 3/16

[52] U.S. Cl. ..... 239/242

[58] Field of Search ..... 239/102.1, 242, 263, 239/264, 252

[56] References Cited

U.S. PATENT DOCUMENTS

| | | | |
|---|---|---|---|
| 2,691,549 | 10/1954 | Hayward | 239/242 |
| 3,073,532 | 1/1963 | Rinkewich | 239/242 |
| 3,924,808 | 12/1975 | Cooley, Jr. | 239/102.1 |
| 4,340,177 | 7/1982 | Huber | 239/242 |

*Primary Examiner*—Andres Kashnikow
*Assistant Examiner*—Karen B. Merritt
*Attorney, Agent, or Firm*—Basil E. Demeur

[57] ABSTRACT

There is disclosed a device for effecting the oscillating movement of a fluid nozzle. The device consists of a housing having a fluid inlet and a fluid outlet, a fluid inlet being adapted to allow fluid under pressure to enter the housing. An impeller is rotationally mounted within the housing positioned in the path of the fluid inlet such that fluid under pressure will rotate the impeller. A gear system is mounted within the housing and is operatively connected to the impeller, and includes a gear arm operatively driven by the gear system at one end and connected to an actuator arm at the other end. The actuator arm interconnects the gear arm with a fluid ejection nozzle such that the rotational movement of the impeller by fluid under pressure causes the gear system to rotate, which in turn rotates the gear arm, causing a concomitant reciprocating movement of the actuating arm and the fluid ejection nozzle. A device such as a shower head connected to the fluid ejection nozzle will similarly realize an oscillating movement.

10 Claims, 2 Drawing Sheets

OSCILLATING DEVICE FOR FLUID NOZZLES

BACKGROUND OF THE INVENTION

The present invention deals with a device which is designed effect an oscillating movement of a fluid ejection nozzle formed as a part of the oscillating device, by means of the use of fluid under pressure. In its preferred embodiment, the present invention is ideally adapted to be interconnected between a water pipe, and a shower head, such that the force of the water under pressure in the pipe as it travels through the oscillating device, will cause an oscillating movement of the shower head attached to the oscillating unit.

The prior art with respect to various types of shower heads is fairly well established. The most current types of shower heads generally include those which have a variety of fluid ejection openings, and will cause a variety of water movement depending upon the fluid outlet opening selected. The typical newest shower heads consist of massage units which have various types of openings to effect different types of water movement resulting in a massage effect, or a pulsating effect. The operator of the shower may select a particular fluid opening by simply rotating the front portion of the shower head until the desired opening is selected and positioned in the path of the fluid opening. It is also well-known that there are a variety of different types of shower heads, each one different from the other by the water pattern which the shower head is able to achieve depending upon its method of construction. However, in virtually all instances, the user of the shower must initially position the angle of the shower head by manually rotating the shower head to the desired angle. It is well-known, for example, that virtually all shower heads include a ball joint adjacent to the point of interconnection of the shower head to the shower pipe. The ball joint permits the operator to adjust the shower head to a desired inclined angle to achieve the optimum exposure of the user's body to the shower. It is quite apparent, however, that in those instances where a shower is utilized by children, or elderly people who are incapacitated, or even partially incapacitated, the ability to reach the shower head for purposes of adjusting the same is difficult if not impossible in some instances. For example, small children are not capable of reaching to the height necessary in order to adjust the shower head. In the case of elderly people, especially those who may have various forms of desease, or otherwise incapacitated to some extent, it is virtually impossible to reach the shower head for adjustment purposes.

It will also be apparent to those who have utilized showers, that even when a shower head is adjusted to the proper angle, the shower head is not capable of ejecting the water to all parts of the body, but rather, the shower head will remain at a stationary angle and is therefore incumbent upon the user of the shower to move in and about the path of the water in order to apply the water to all parts of the body. This again is a difficult procedure for people who have incapacities, or for small children who may be prone to slipping on a wet tub floor surface.

It has therefore been deemed desirable to develop a device which may be interposed between the shower pipe and the shower head, which will effect an oscillating movement to the shower head during the showering process. In this manner, the shower head will continuously move between a high point and a low point which is selected between the highest point that one would want a shower head adjusted to, to the lowest point of such adjustment. In this manner, during the process of one showering, the shower head will move between the high and low point for several cycles, and permit the user thereof to have the water movement pathway extend from the very bottom to the very top of the user's body. The path of travel, being between a very high and a very low point, will in effect be useful for all persons, including children, and those having any form of incapacity such that adjustment of the shower nozzle in the first incidence is difficult if not impossible.

In addition, the present invention contemplates an adjustment feature whereby the device may be adjusted to slow the oscillating movement of the shower head, or to stop the same entirely. In this manner, by a simple manual adjustment handle, a shower head connected to the oscillating device may be variously adjusted to any given inclined angle depending upon the needs of the user, or may be left in the oscillating mode entirely.

Insofar as the prior patented art is concerned, the prior art basically only shows shower heads which may have certain different types of water patterns, but each of which are selected by means of an adjustment feature in the shower head. For example, the shower head shown in patent 3,791,584, is directed to a shower head having a nozzle assembly and a discharge adjusting member such that one can adjust the mode of discharge of the water therefrom thereby to change the type of water movement which is ejected from the shower head. It will be noted, however, that the shower head per se is only adjustable by means of a ball joint, and there is nothing to effect the oscillating movement of the shower head on a continuous basis.

OBJECTS AND ADVANTAGES

It is therefore the object of the present invention to provide an oscillating device which may be interposed between a source of water under pressure, and a shower head, and which will cause the oscillating movement of the shower head in response to the pressure of the water traveling through the oscillating device.

In conjunction with the foregoing object, it is a further object of the present invention to provide an oscillating device of the type generally described, wherein the device includes a fluid inlet and a fluid outlet, an impeller rotationally mounted in the device's housing and positioned in the path of the fluid inlet such that fluid under pressure will cause a rotational movement of the impeller, a gear system mounted within the housing and being operatively connected to the impeller, gear arm means operatively driven by the gear system at one end and terminating at an opposed end which is in turn affixed to an actuator arm, fluid outlet means which comprises a fluid ejection nozzle mounted within the fluid outlet opening and adapted for oscillating movement, such that the rotational movement of the gear arm means causes a reciprocating movement to the actuator arm and to the fluid ejection nozzle. A shower head may be mounted to the fluid ejection nozzle, and will in turn, achieve an oscillating movement.

In conjunction with the foregoing objects, it is a further object of the present invention to provide an oscillating device of the type described, which further includes brake means associated with the impeller, whereby the brake means may be actuated to reduce or stop the movement of the impeller.

In conjunction with the foregoing object, it is a further object of the present invention to provide an oscillating device of the type described, wherein the brake means is formed by the brake pad having a curvilinear oblong configuration and is positionally mounted adjacent to the impeller, such that the brake pad may be variously adjusted between slight touching contact with the impeller to slow the movement of the impeller and hence, slow the oscillating movement of the shower head, or may be variously moved into a braking posture thereby to completely stop the impeller and thereby fix the shower head in any given angle position.

In conjunction with the foregoing objects, it is a further object of the present invention to provide an oscillating device of the type described which includes a brake system, and wherein the brake system includes a manual adjustment means extending downwardly from the oscillating device such that the brake system may be easily and manually adjusted by the user of the shower head, obviating the need to actually grasp the shower head for adjustment purposes. In this manner, adjustment is made by the user at a point removed from the oscillating device and the shower head.

Further features of the invention pertain to their particular arrangement of the parts whereby the above-outlined and additional operating features thereof are obtained.

The invention, both as to its organization and method of operation, together with further objects and advantages thereof, will best be understood by reference of the following specification taken in connection with the accompanying drawings.

SUMMARY OF THE INVENTION

In summary, the present invention is directed to an oscillating device which is intended to be interposed between a shower head, and a source of water under pressure, whereby the shower head may achieve an oscillating movement during a bathing procedure. The oscillating device of the present invention is formed by a housing having a fluid inlet and fluid outlet port, the fluid inlet port being in a direct pathway with an impeller located within the housing. The impeller is induced to move by fluid under pressure, this in turn causes a rotary movement to a series of planetary gears which amount to a gear reduction system, and in turn move a gear arm in a rotational pathway. The device includes a fluid ejection nozzle mounted on a base, which includes an actuator arm mounted thereto, the actuator arm of the fluid ejection nozzle base and the gear arm of the gear box assembly being interconnected by a connector arm such that the rotational movement of the gear arm translates into a reciprocating movement of the actuator arm and hence, the fluid ejection nozzle. The resulting mechanical movement is to achieve an oscillating movement of the fluid ejection nozzle such that a shower head connected thereto will oscillate from a high point to a low point in a single plane.

The impeller also includes a brake system associated therewith such that rotational movement of the impeller may be reduced or completely stopped in order to position the shower head in any desired position along the verticle path of movement. Hence, the rate of oscillation may be adjusted, or in the alternative, the shower head may be stopped at any desired point to eliminate the oscillating movement.

DETAILED DESCRIPTION OF THE INVENTION

As illustrated in FIGS. 1 through 4 of the drawings, the present invention is directed to a device, generally referred to herein as an oscillator 10, which is primarily adapted to be interposed between a shower head 12, and a shower pipe 14. The design of the oscillator 10 is such that any shower head 12 may be screw-threadedly mounted thereon such that the oscillator 10 may be utilized with a variety of shower heads as desired by the user.

Figure 1:
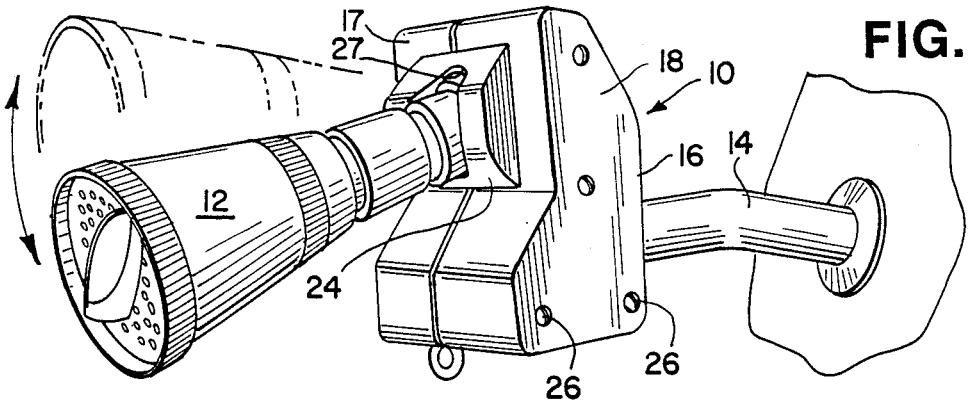
FIG. 1 is a perspective view showing the oscillating device as interposed between a shower head and a shower pipe.
Figure 2:
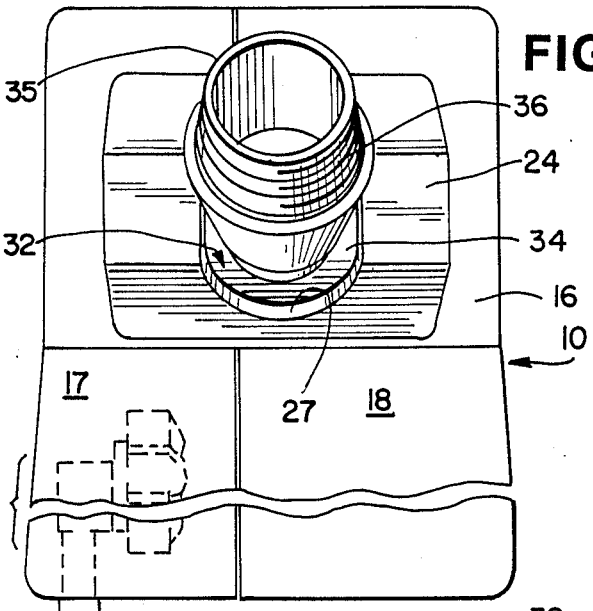
FIG. 2 is a front elevational view, partly broken away, showing the fluid ejection nozzle portion of the device and the elongate brake arm handle associated with the subject device.
Figure 4:
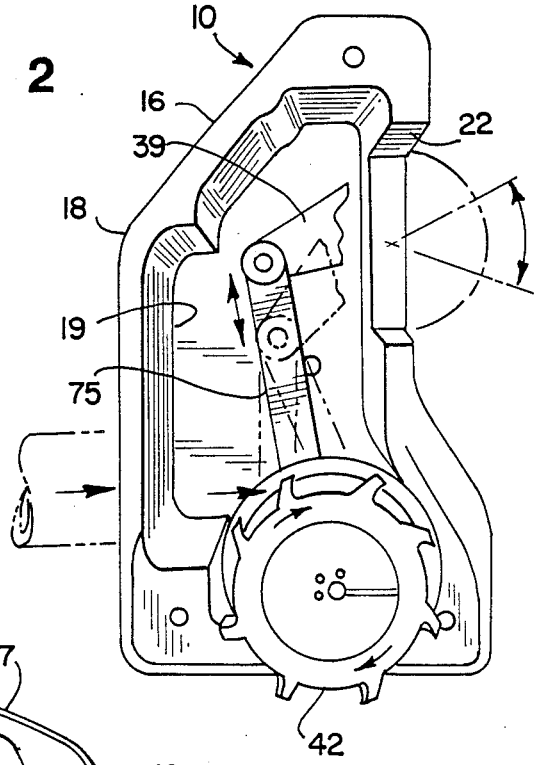
FIG. 4 is a side elevational view, partly in crosssection, showing the fluid inlet in combination with impeller and fluid outlet portions of the device illustrating the manner in which the impeller operates the ejection nozzle.
Figure 3:
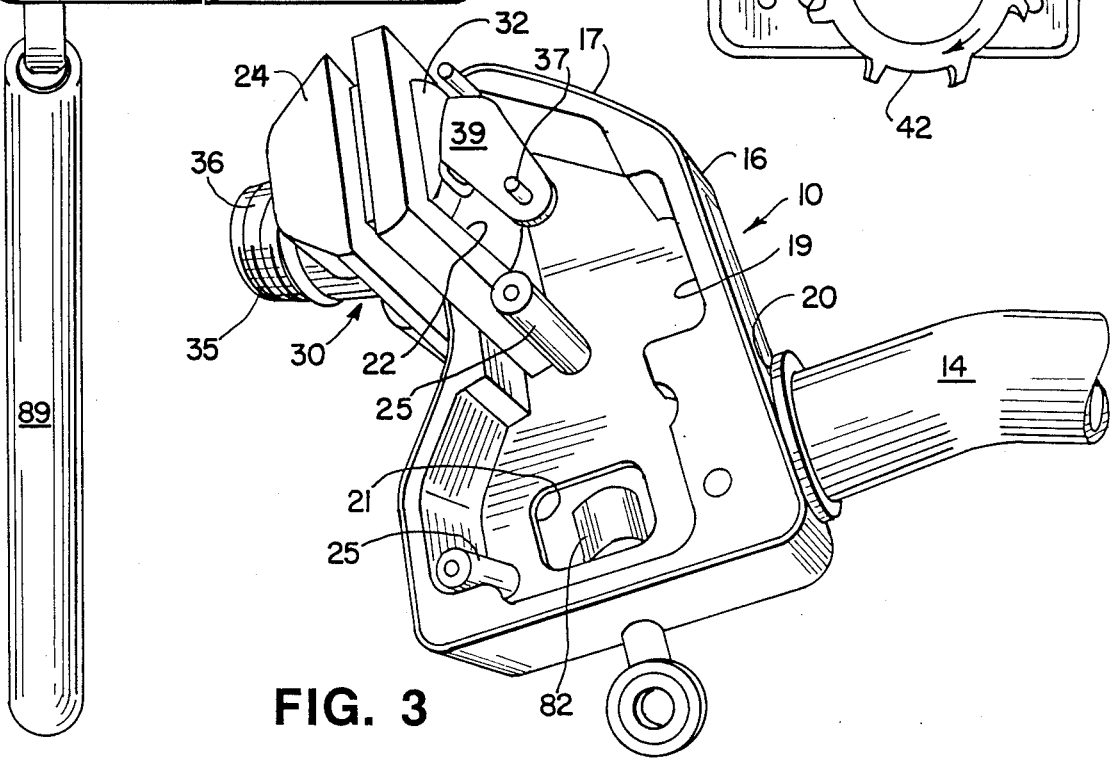
FIG. 3 is a side elevational view showing the housing portion of the oscillating device illustrating the fluid inlet and fluid outlet portions thereof.

The oscillator 10 is generally formed by a housing 16 which, as illustrated in FIG. 1 of the drawings, may consist of a first section 17 and a second section 18 which are bolted or otherwise screwed together. FIGS. 3 and 4 of the drawings illustrate the two half sections, 17 and 18 of the housing 16 respectively. The housing 16 includes an inner chamber 19 in which the fluid ejection assembly 30 and impeller assembly 40 are positioned. The housing 16 is provided with a fluid inlet port 20 and a fluid outlet opening 22. Pipe 14 accommodates the screw threaded mounting of the fluid inlet port 20 onto the shower pipe 14 in the same manner as a shower head 12 would normally be mounted to the shower pipe. The fluid ejection assembly 30 is positioned within the fluid outlet opening 22 in a manner which permits the oscillating movement of the fluid ejection assembly 30 as positioned within the opening 22. The outer portion of the housing 16 includes a nozzle seat 24 which is fixedly secured to the outer portion of the housing, and in which the nozzle assembly 30 is seated.

As shown by the embodiment illustrated in FIGS. 1 through 4 of the drawings, where the housing 16 is formed by a first section 17 and second section 18, the first section 17 is shown to include a plurality of screw receiving studs 25 which are integrally formed with the housing, and which are designed to receive the screws 26 which hold the two sections 17 and 18 together as illustrated in FIG. 1.

Figure 5:
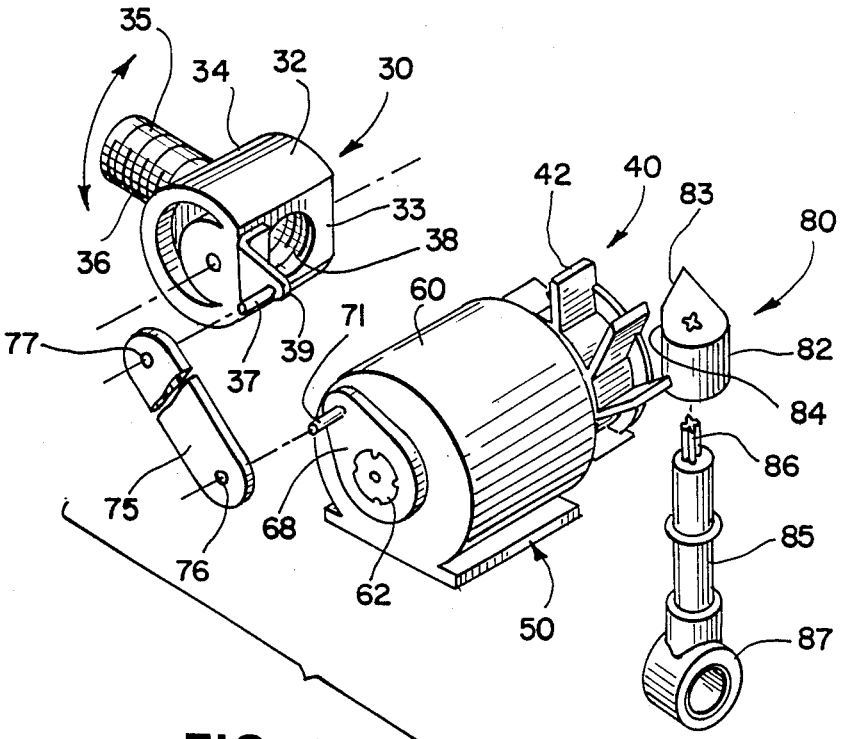
FIG. 5 is a prospective broken away view showing the interior portion of the oscillating device including the impeller in combination with the gear box, and the fluid ejection base and nozzle portion and illustrating the positioning of the impeller brake.

As more particularly shown in FIG. 5 of the drawings, the nozzle assembly 30 is formed by a nozzle base 32 which has a substantially circular configuration, and a flat rear surface 33. The front face 34 includes a fluid ejection nozzle 35 fixedly secured thereto which includes a screw threaded mounting portion 36 associated therewith in order to accommodate the screw threaded mounting of a shower head 12 thereon. It will be appreciated from a view of FIGS. 1, 2, and 3 of the drawings, that the interior surface of the nozzle seat 24 is curvilinear in shape, in order to accommodate the smooth movement of the nozzle base 32 therein incident to the oscillating movement of the fluid ejection assembly 30 when the device operates. Hence, the circular configuration of the nozzle base 32 helps accommodate the easy oscillating movement of the nozzle base 32 within the seat 24. As also shown in FIG. 5 of the drawings, a fluid outlet port 38 traverses the nozzle base 32 and is co-extensive with the fluid ejection nozzle 35 such that water under pressure is able to flow through the port 38 and exit via the fluid nozzle 35.

The rear flat surface 33 of the nozzle base 32 is shown to include an actuator arm 39 fixedly secured thereto which functions in a manner to be more particulary defined hereinafter.

Figure 6:
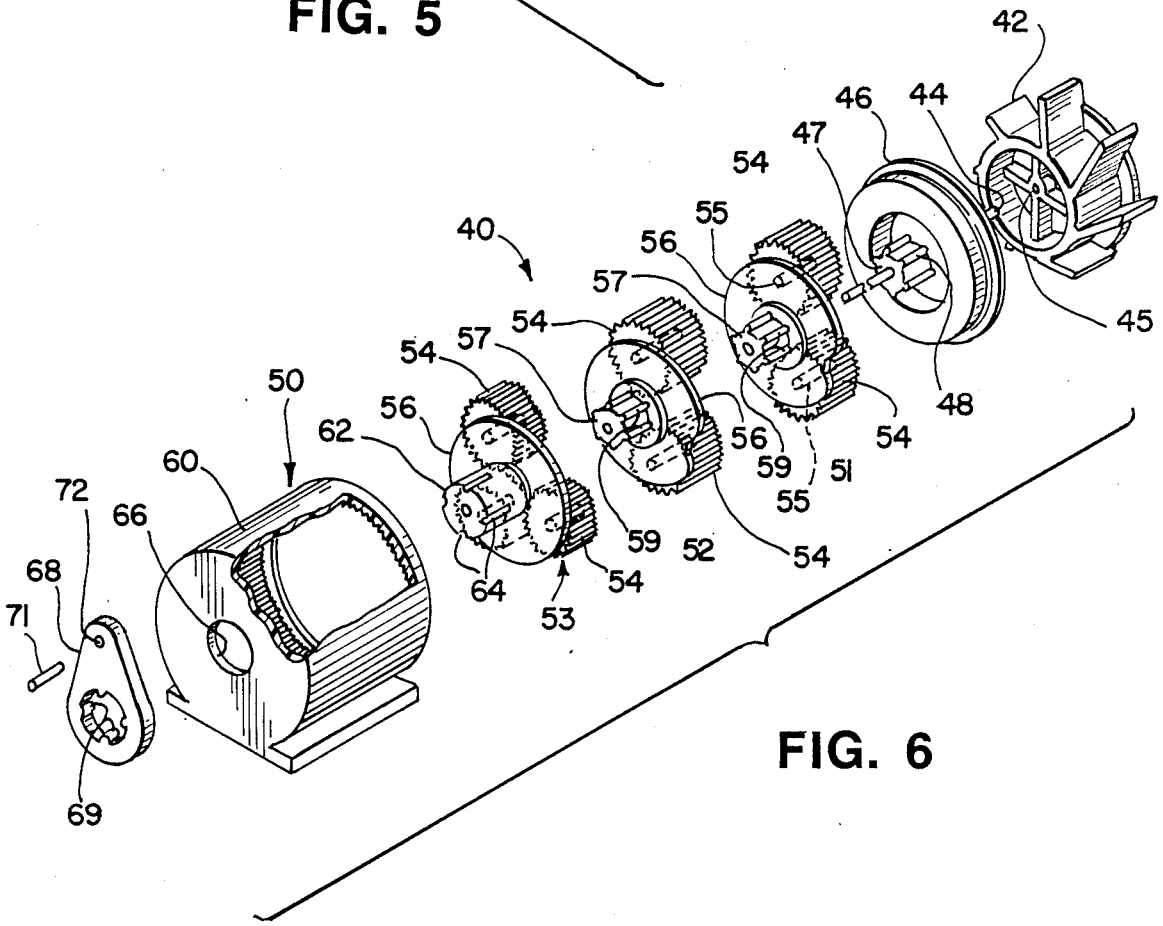
FIG. 6 is an exploded view of the gear assembly in combination with the gear box showing the manner in which the impeller operates the gearing system and the gear arm to cause rotary movement thereof.

FIGS. 5 and 6 of the drawings more clearly illustrate the impeller assembly 40. As shown therein, an impeller wheel 42 is shown to be mounted to the gear box assembly 50 and adapted for rotational movement by being mounted on a mounting pin 44 which seats in a pin receiving hub 45. A circular bushing plate 46 provides a riding surface against which the impeller wheel 42 is seated incident to its rotational movement. At the opposed end of the mounting pin 44 is an impeller hub 47 which is provided with external ribs 48 which co-act with the gear assembly as will be more fully explained hereinafter.

The gear box assembly 50 will be understood by those skilled in the art in that the same consists of three sets of planetary gears 51, 52, and 53 respectively. As is well-known in the art, each of the planetary gear assemblies includes a series of three-toothed gear wheels 54 which are rotationally mounted on studs 55 which are fixedly secured to a gear plate 56. The gear plate 56 includes a central gear hub 57 as shown in FIG. 6. As noted in FIG. 6, the first planetary gear assembly 51 is designed such that the gear hub 57 accommodates the engagement of the impeller hub 47 therein, and is shown to be provided with external ribs 59 such that the impeller hub 47 may be seated within the confines of the gear hub 57. The ribs 48 of the impeller hub 47 seat within the ribs 59 of the gear hub 57 and it will be apparent that as the impeller wheel 42 rotates, the impeller hub 47 will similarly rotate, and cause a concomitant rotation of the gear plate 56.

Each of the planetary gear assemblies 52 and 53 are similarly constructed, and it is therefore not deemed necessary to describe in detail each of such gear assemblies. For sake of convenience, like numerals have been utilized to refer to the respective parts of each of the first, second, and third planetary gear assemblies 51, 52, and 53 respectively. It will be noted that the gear box 60 includes an internally toothed circular surface in which the gear wheels 54 will ride when in the assembled configuration. It will also be appreciated that the third planetary gear assembly 53 includes a gear hub 62 having an external surface including a plurality of grooves 64, the gear hub 62 being designed to pass through a hub opening 66 and the gear box 60. A gear arm 68 is seated on the hub 62 in the manner shown in FIG. 5 of the drawings. The gear arm 68 is provided with a series of corresponding groove flanges 69 which are adapted to seat in the grooves 64 of the hub 62. In this manner, a positive mounting of the gear arm on the gear hub 62 is achieved.

It will further be appreciated that the first, second, and third planetary gear assemblies 51, 52, and 53 respectively may be made in the form of a gear reduction system such that the respective gear wheels 54 are consecutively smaller in size as is well-known to one skilled in the art. For example, as shown in FIG. 6 of the drawings, the gear wheels 54 of the first planetary gear assembly 51 are slightly larger than the respective gear wheels 54 of the second planetary gear assembly 52, which are in turn slightly larger than the gear wheels 54 of the third planetary gear assembly 53. In this manner, a more controlled rotational movement is transferred to the gear arm 68 once the impeller wheel 42 is rotated by means of fluid under pressure. Any particular gear assembly may be utilized for the purpose of transferring the rotational movement of the impeller wheel 42 to the gear arm 68.

It will further be noted that the gear arm 68 is provided with a mounting pin 71 which is fixedly secured within in a mounting aperture 72. As indicated previously, the nozzle base 32 of the fluid ejection assembly 30 is provided with an actuator arm 39, which is also provided with a mounting pin 37 fixedly secured thereon. It will therefore be appreciated that the gear arm 68 may be interconnected to the actuator arm 39 by means of a connector arm 75. As shown in FIG. 5 of the drawings, the connector arm 75 is provided with a pair of opposed mounting apertures 76 and 77 respectively. As illustrated therein, the connector arm may be suitably connected to the gear arm 68 by mounting the mounting pin 71 in mounting aperture 76, and is interconnected to the actuator arm 39 by mounting the mounting pin 37 in the aperture 77. It will therefore be appreciated that as the impeller wheel 42 rotates, the planetary gear assemblies 51, 52, and 53 are similarly rotated, ultimately causing a rotational movement of the gear arm 68. Such rotational movement will cause a reciprocating movement in the connector arm 75, which will in term reciprocate the nozzle base 32 and the fluid ejection nozzle 35 mounted thereon. Hence, the rotational movement of the impeller wheel 42 translates to a reciprocating or oscillating movement of the nozzle 35 along the path of travel bounded by the nozzle seat 24. In this connection, it is noted that the nozzle seat 24 is provided with a travel limiting slot 27 (See FIGS. 1 and 2) and it will be appreciated that the ejection nozzle 35 will travel within the confines of the slot 27.

As further shown in FIGS. 3 and 5 of the drawings, the impeller wheel 42 is further provided with a brake assembly 80 which operates to either reduce the rotary movement of the impeller wheel 42, or to stop the same completely. The brake assembly 80 is formed by means of a brake pad 82 which is mounted on the housing 16 at a point adjacent to the impeller wheel 42. As shown in FIG. 3 of the drawings, the housing 16 is provided with a brake access opening 21 which is positioned adjacent to the impeller wheel 42. The brake pad 82 assumes a curvilinear configuration as generally illustrated in FIG. 5, resulting in a narrow section 83 adjacent the front portion of the brake pad 82 and a thicker section 84 adjacent the rear portion of the brake pad 82. This configuration of the brake pad 82 permits the pad 82 to lightly touch the impeller wheel 42 at the narrow section portion 83 thereof, or to completely stop the impeller wheel 42 when the thick section 84 butts up against the impeller wheel 42. The brake assembly 80 is completed by means of a brake arm 85 which is provided with a mounting stud 86 at its upper end, and a handle mounting fixture 87 at its lower end. A grasp handle 89 (FIG. 2) is mounted on the handle fixture 87 and extends downwardly therefrom. It will be appreciated that the rotary movement of the grasp handle 89 causes a resulting rotary movement of the brake arm 85, and hence turns the brake pad 82 in one direction or the other. It will be appreciated that the person utilizing the shower may, at any given point in time, simply rotate the grasp handle 89 thereby to rotate the brake pad 82 into a braking position relative to the impeller wheel 42 to either slow the impeller wheel 42, or completely stop the impeller wheel when the thickened section 84 of the brake pad 82 is in full contact with the impeller wheel 42. In viewing the assembly, it will be appreciated that if the narrow section 83 of the break pad 82 is in touching contact with the impeller wheel, the breaking action is achieved, and this will in turn slow the oscillating movement of the shower head as the device operates. If the thickened section 84 of the break pad 82 is in full contact with the impeller wheel 42, the same will stop rotational movement, and will fix the shower head 12 in whatever position it is in when the movement is stopped.

It will be appreciated from the above description that the present invention provides a convenient accessory feature especially adapted for shower heads, which permits the user of the shower to achieve and oscillating movement of the shower head during the shower procedure. Such an oscillating movement in effect causes the shower head to oscillate between a high point and a low point which, during a showering procedure, means that the water will spray the user of the shower from a high point which would be around the head portion of the body, to a low point which would be the toe portion of the body. Additionally, the shower head may be stopped at any given point by simply manipulating the grasp handle 89 in the manner indicated, such that oscillating movement ceases completely. It will therefore be appreciated that the oscillator of the present invention is ideally suited for use by children as well as persons having disabilities which prevents them from grasping and manipulating a shower head into the desired position in order to engage in a showering procedure. Hence, the oscillator of the present invention has applicability for elderly people as well as those suffering from disabilities which would prevent such a person, including children, from adjusting a shower head prior to a showering procedure.

Furthermore, the oscillator of the present invention permits easy installation since it may be easily screw threaded onto a shower pipe, at its one end, and installing any appropriate shower head at the fluid outlet portion thereof. Hence, a great degree of flexability is achieved since the user is permitted the option of utilizing any shower head which otherwise screw-threadedly mounts to a shower pipe in the normal manner.

While there has been described what is at present to be considered to be the preferred embodiments of the invention, it will be understood that various modifications may be made therein and it is intended to cover in the appended claims all such modifications as fall within the true spirit and scope of the invention.

I claim:

1. A device adapted for direct attachment to a fluid pipe at one end and accommodating the attachment of a fluid nozzle at its opposed end for effecting the oscillating movement of a fluid nozzle in a vertical plane comprising in combination, a housing having a fluid inlet and a fluid outlet means mounted within a fluid outlet opening and spaced from said fluid inlet, said fluid inlet adapted to allow fluid under pressure to enter said housing, an impeller rotationally mounted within said housing and positioned in the path of fluid under pressure entering said housing through said fluid inlet thereby to rotate said impeller under the force of fluid under pressure, a gear system mounted within said housing and being operatively connected to said impeller, gear arm means operatively driven by said gear system at one end thereof and termination at an opposed end, said fluid outlet means comprising a fluid ejection nozzle mounted within the fluid outlet opening and adapted for oscillating movement in a vertical plane, said fluid ejection nozzle including connecting means for accommodating the engagement thereto of a shower head in linear alignment with said fluid ejection nozzle, and an actuator arm fixedly secured to said fluid ejection nozzle including mounting means associated therewith to accommodate the securement thereto of the opposed end of said gear arm means, whereby the rotational movement of said impeller caused by fluid under pressure causes a concomitant movement of said gear system which in turn causes a rotary movement of said gear arm means resulting in a reciprocating movement of said actuator arm and said fluid ejection nozzle in a vertical plane.

2. The oscillating device as set forth in claim 1 above, wherein said gear system comprises a series of gear reduction wheels being interconnected and operationally connected to said gear arm means whereby rotational movement of said gear reduction wheels causes a concomitant movement of said gear arm means which in turn causes a reciprocating movement of said actuator arm and said fluid ejection nozzle.

3. The oscillating device as set forth in claim 2 above, wherein said series of gear reduction wheels comprises a series of three sets of planetary gear wheels, each set mounted on a gear plate, and each gear plate adapted to operate the next adjacent series of planetary gears, the third set of planetary gear wheels having a gear hub which interconnects with said gear arm means whereby rotational movement of said planetary gear wheels will cause a concomitant movement of said gear arm means.

4. The oscillating device as set forth in claim 3 above, wherein said gear arm means comprises a gear arm having a central mounting aperture for fixedly mounting said gear arm to said gear hub, and an outer end having a mounting pin for mounting said gear arm to a mounting eyelet of a connector arm having two ends and a mounting eyelet at each end.

5. The oscillating device as set forth in claim 4 above, wherein said actuator arm includes a mounting stud secured thereon and extending outwardly therefrom, said mounting stud adapted for mounting engagement with the other mounting eyelet of said connector arm thereby to operatively interconnect said gear arm to said actuator arm.

6. The oscillating device as set forth in claim 1 above, wherein said fluid outlet means comprises a nozzle base mounted within said fluid outlet opening, said nozzle base having a fluid channel traversing therethrough formed by a fluid inlet port and a fluid ejection nozzle forming a fluid outlet port, and an actuator arm mounted on said fluid base whereby reciprocating movement of said actuator arm causes a concomitant oscillating movement of said fluid ejection nozzle.

7. The oscillating device as set forth in claim 1 above, wherein said device further includes brake means associated with said impeller whereby said brake means may be actuated to reduce and stop the movement of said impeller.

8. The oscillating device as set forth in claim 7 above, wherein said brake means comprises a brake pad mounted on said housing positionally adjacent to said impeller and includes manual means for adjusting said brake pad into a braking position relative to said impeller.

9. The oscillating device set forth in claim 8 above, wherein said brake pad has a curvilinear oblong configuration whereby said brake pad may be adjusted between a slight braking posture relative to said impeller thereby to slow the rotational movement thereof, and to a full braking posture relative to said impeller thereby to completely stop said impeller, whereby the rotational speed of said impeller may be variously adjusted causing a concomitant adjustment of the speed of oscillation of said fluid ejection nozzle.

10. The oscillating device as set forth in claim 8 above, wherein said brake pad further includes a handle having one end fixedly secured to said brake pad, and an opposing end extending outwardly from said housing to permit adjustment of said brake pad from a position externally of said housing.

* * * * *